US012180703B2

(12) United States Patent
Seidel et al.

(10) Patent No.: US 12,180,703 B2
(45) Date of Patent: Dec. 31, 2024

(54) DRYWALL AS WELL AS A KIT AND A METHOD FOR CONSTRUCTING A DRYWALL

(71) Applicant: Knauf Gips KG, Iphofen (DE)

(72) Inventors: Jochen Seidel, Iphofen (DE); Volker Müller, Kitzingen (DE)

(73) Assignee: Knauf Gips KG, Iphofen (DE)

( * ) Notice: Subject to any disclaimer, the term of this patent is extended or adjusted under 35 U.S.C. 154(b) by 84 days.

(21) Appl. No.: 17/785,193

(22) PCT Filed: Dec. 16, 2019

(86) PCT No.: PCT/EP2019/000338
§ 371 (c)(1),
(2) Date: Jun. 14, 2022

(87) PCT Pub. No.: WO2021/121534
PCT Pub. Date: Jun. 24, 2021

(65) Prior Publication Data

US 2023/0008578 A1 Jan. 12, 2023
US 2024/0271418 A2 Aug. 15, 2024

(51) Int. Cl.
*E04B 2/74* (2006.01)
*E04B 1/82* (2006.01)
(Continued)

(52) U.S. Cl.
CPC ..... *E04B 2/7409* (2013.01); *E04B 1/82* (2013.01); *E04B 2/58* (2013.01); *E04B 2/7457* (2013.01); *E04B 2/789* (2013.01); *E04B 2/828* (2013.01)

(58) Field of Classification Search
CPC ..... E04B 1/82; E04B 2/58; E04B 2/82; E04B 2/7409; E04B 2/7457; E04B 2/789; E04B 2/828
See application file for complete search history.

(56) References Cited

U.S. PATENT DOCUMENTS 3,360,892 A * 1/1968 Rosso ..... E04B 2/56 52/648.1
3,363,377 A * 1/1968 Beckman ..... E04B 2/789 52/275
(Continued)

FOREIGN PATENT DOCUMENTS

EP 2 703 575 A1 3/2014
EP 3 464 744 A1 4/2019
(Continued)

OTHER PUBLICATIONS

International Search Report prepared by the European Patent Office ISA and mailed on Aug. 31, 2020; 3 pages.
(Continued)

*Primary Examiner* — Jessie T Fonseca
(74) *Attorney, Agent, or Firm* — Amburn Law PLLC; Dean W. Amburn

(57) ABSTRACT

The invention relates to a drywall comprising a first wall section (2) with first stud elements (4), wherein the first stud elements are arranged with a first regular centre distance, wherein in the first wall section a first panelling (5) is arranged at least on one room side (R) of the first stud elements (4). The drywall is characterized by a second wall section (3) with second stud elements (6), wherein a second panelling (7) is arranged in the second wall section at least on the room side (R) of the second stud elements (6) and wherein the second stud elements are arranged with a second regular centre distance (C) which is smaller than the first regular centre distance (A). The invention also relates to a kit and a method for constructing a drywall.

10 Claims, 4 Drawing Sheets

(51) Int. Cl.

| | |
|---|---|
| ***E04B 2/58*** | (2006.01) |
| ***E04B 2/78*** | (2006.01) |
| ***E04B 2/82*** | (2006.01) |

(56) References Cited

U.S. PATENT DOCUMENTS

| | | | | |
|---|---|---|---|---|
| 2009/0038246 | A1* | 2/2009 | Wright | E04C 3/07 52/220.1 |
| 2017/0284090 | A1* | 10/2017 | LeBlang | E04B 2/58 |

FOREIGN PATENT DOCUMENTS

| | | | | |
|---|---|---|---|---|
| JP | 2009-001962 | A | 1/2009 | |
| JP | 2010-265645 | A | 11/2010 | |
| KR | 101993745 | B1 * | 10/2019 | |
| WO | WO 98/45545 | A1 | 10/1998 | |
| WO | WO-0065166 | A1 * | 11/2000 | E04B 2/58 |
| WO | WO-2005100709 | A1 * | 10/2005 | B32B 15/08 |
| WO | WO-2009066861 | A1 * | 5/2009 | E04B 2/7412 |
| WO | WO-2016095937 | A1 * | 6/2016 | E04B 2/789 |
| WO | WO-2019043405 | A1 * | 3/2019 | E04B 1/14 |
| WO | WO-2019172040 | A1 * | 9/2019 | E04B 1/86 |

OTHER PUBLICATIONS

Written Opinion prepared by the European Patent Office ISA and mailed on Aug. 31, 2020; 6 pages.

Machine-assisted English language translation of European Patent No. EP 2 703 575 A1 extracted from www.espacenet.com on Jun. 14, 2022; 12 pages.

Abushwereb, Mahmud, Hexu Liu, and Mohamed Al-Hussein. "A knowledge-based approach towards automated manufacturing-centric BIM: wood frame design and modelling for light-frame buildings." Modular and Offsite Construction (MOC) Summit Proceedings (2019): 100-107.

Canadian Patent Office, Examiner Requisition dated Mar. 8, 2024.

* cited by examiner

DRYWALL AS WELL AS A KIT AND A METHOD FOR CONSTRUCTING A DRYWALL

CROSS-REFERENCE TO RELATED APPLICATIONS

The subject patent application is a U.S. National Stage Patent Application which claims priority to and all the benefits of International Patent Application No. PCT/EP2019/000338, filed on Dec. 16, 2019, the disclosure of which is hereby incorporated by reference.

TECHNICAL HELD

The invention relates to a drywall comprising a first wall section with first stud elements, wherein the first stud elements are arranged with a first regular center distance, wherein in the first wall section a first paneling is arranged at least on a room side of the first stud elements. The invention also relates to a kit and a method for constructing such a drywall.

BACKGROUND

Drywalls are known. These typically comprise stud elements made of wood or of metal studs, to which a paneling is attached on one side or on both sides. Such a drywall is described in DE 100 13 991 C1. Drywalls can be provided in a building without assuming a load-beading function in relation to the building structure. On the other hand, drywalls can also assume a load-bearing function in relation to the building structure and then become load-bearing building elements. For this purpose, the drywall can be created using stud elements made of light-gauge steel studs, wherein light-gauge steel studs are particularly stable and typically have a greater material thickness than studs for dry construction without a load-bearing function.

SUMMARY

It is an object of the present invention to improve the sound insulation achieved by the drywall in a simple way.

This object is achieved by a drywall having novel characteristics as described and claimed. Accordingly, the aforementioned drywall has a second wall section with second stud elements, wherein a second paneling is arranged in the second wall section at least on the room side of the second stud elements and wherein the second stud elements are arranged with a second regular center distance which is smaller than the first regular center distance. By this arrangement, a considerable improvement in sound insulation can be achieved. In architectural acoustics, when determining the sound reduction index of a building element, such as in particular a drywall, a basic distinction is made between the (direct) sound passage through a partition wall between two rooms and flanking transmission, i.e. the transmission of sound through flanking components, such as a common side wall. The direct sound passage is influenced by the sound insulation of the (drywall) between the rooms, while for the flanking transmission, the flanking sound insulation of the common side wall, inter alia, is decisive. The invention improves in particular the propagation loss of the drywall. This, in turn, has a positive effect in particular on the flanking sound insulation between two rooms, if the drywall forms a flanking component to a partition wall.

The invention has recognized that a drywall having a first wall section and a second wall section can significantly improve sound insulation by means of the drywall having a smaller regular center distance of the stud elements in the second wall section. In dry construction, stud elements are typically arranged in a row next to each other. The regular center distance describes the distance between the center lines of the bearing surfaces of the respective stud elements on which the paneling is arranged. This does not exclude, for example, the possibility that some of the stud elements are arranged with a different center distance. In particular, this is the case if a wall is less wide than can be achieved with regularly spaced stud elements, for example because a stud element is to be arranged at each end of the wall for reasons of stability. A regular first center distance is preferably present if at least three (particularly preferred at least four) first stud elements arranged side by side in a row are each arranged with the same center distance. A regular second center distance is preferably present if at least three (particularly preferred at least four) second stud elements arranged side by side in a row are each arranged with the same center distance. The stud elements shall be installed with the usual tolerances for dry construction. The term "the same center distance" is also to be understood within the scope of these usual tolerances. Preferably, the regular first center distance is a maximum center distance in the area of the first wall section.

Preferably, the regular second center distance is a maximum center distance in the area of the second wall section.

The claimed drywall can be constructed cost-effectively; in particular, the construction can be carried out in a time-saving manner. In addition, the construction can be carried out reliably so that the desired improved sound insulation can be achieved even under different conditions in the building. According to the invention, the first and second stud elements can be designed identically or differently. It may also be provided that the first and second panelings form an uninterrupted wall paneling.

In the following, advantageous embodiments of the drywall are described, wherein the respective characteristics refer not only to the drywall, but also to the kit and the method for the construction of a drywall.

According to an advantageous embodiment of the invention the first stud elements have first bearing surfaces for the first paneling and the second stud elements have second bearing surfaces for the second paneling. Preferably, the first stud elements are arranged side by side in such a way that the first center distance formed from the distance between the center lines of the first bearing surfaces of at least three first stud elements is in each case equal and thus regular. Preferably, the second stud elements are arranged side by side in such a way that the second center distance formed from the distance between the center lines of the second bearing surfaces of at least three of the second stud elements is in each case equal and thus regular. Preferably, the first and second stud elements are arranged in such a way that the first center lines of the first bearing surfaces and the second center lines of the second bearing surfaces are vertically arranged.

Particularly good sound insulation can be achieved if the second regular center distance in the second wall section is less than 80% of the first regular center distance in the first wall section. Especially preferred, the second regular center distance is less than 60% of the first regular center distance. It is further preferred that the second regular center distance is more than 25% of the first regular center distance. The construction of the drywall is particularly easy if the second regular center distance is half of the first regular center distance.

A particularly preferred embodiment of the invention provides that in the second wall section, in front of the second paneling, a facing shell is arranged comprising third stud elements with a facing shell paneling arranged thereon. In this way, the sound-insulating properties can be further improved. At the same time, the construction costs are kept low, since the provision of a facing shell only in the second wall section already achieves a considerable improvement in the sound-insulating properties.

The facing shell can be arranged in such a way that it protrudes from the first paneling towards the room side.

Improved sound-insulating properties can also be achieved, in particular, if the drywall in the area of the second wall section forms a recess on the room side, with the facing shell being arranged in the recess. For this purpose, it may be provided that the second paneling is arranged with an offset to the first paneling to form the recess. The offset can match the depth of the recess. It is preferred for the offset to be at least 20% of the second width described below. Due to the fact that the second regular center distance is smaller than the first regular center distance, the number of second stud elements per meter wall length of the second wall section is larger than the number of first stud elements per meter wall length of the first wall section. In this way, the drywall is reinforced in the area of the second wall section. This allows for reducing the width of the second stud elements to form the recess without losing load-beating capacity.

A preferred embodiment provides that the facing shell fills the recess in such a way that the facing shell paneling is flush with the first paneling. In particular, the paneling of the facing shell and the second paneling can be arranged in one plane. This allows a stepless surface of the first and second wall sections to be obtained on the room side.

A preferred embodiment provides that a horizontal width of the second wall section is more than a quarter of a maximum wall height of the drywall in the area of the second wall section. Preferably, the horizontal width is more than one third of the maximum wall height. However, good results are already achieved if the horizontal width is smaller than the wall height.

A preferred embodiment provides that a horizontal width of the facing shell is more than a quarter of a maximum wall height of the drywall in the area of the second wall section. Preferably, the horizontal width of the facing shell is more than one third of the maximum wall height. However, good results are already achieved if the horizontal width of the recess is smaller than the wall height.

A preferred embodiment is for the facing shell to extend vertically over the entire height of the drywall. In a particularly preferred way, the facing shell extends over the entire horizontal width of the second wall section.

An advantageous embodiment of the invention provides that the first stud elements have a first width in a direction perpendicular to their longitudinal axis, and that the second stud elements have a second width in a direction perpendicular to their longitudinal axis, the first width being greater than the second width. If the stud elements are metal studs, the first and second widths may correspond to the width of the stud web. This contributes in particular to a good sound insulation. With this measure, inter alia, the recess can be formed in an easily producible manner. Preferably, the first width is more than 20% larger than the second width.

According to the invention, the first and/or second stud elements can be, in particular, wooden stands or studs.

In particular, the studs may be made of sheet metal with a material thickness of between 0.4 mm and 1 mm. With such thin-walled dry-construction studs, good sound insulation can be achieved at low manufacturing costs, especially for non-load-bearing walls.

Furthermore, the studs may be made of sheet metal with a material thickness of between 1 mm and 5 mm. Preferably, the material thickness lies between 1.5 mm and 3 mm. In this way, a particularly good sound insulation is achieved. In particular, this measure significantly improves sound propagation loss. In addition, these studs can assume a static function in the building so that load-bearing walls can be created, which, in particular, can also be created as exterior walls of buildings.

A particularly preferred embodiment provides that the first stud elements comprise first studs having a first stud web and two first stud flanges disposed on the first stud. web, wherein the first stud web has a first stud web width, and that the second stud elements comprise second studs having a second stud web and two second stud flanges disposed on the second stud web, wherein the second stud web has a second stud web width, and wherein the first stud web width is greater than the second stud web width. By using studs with different web widths, wall structures of different widths can be realized, while observing the respective minimum static requirements. In order to create a wall section having a recess, either the studs in the recess area can be narrower or the studs can be provided with less thick paneling. However, reducing the thickness of the paneling is the less suitable solution in terms of acoustic effects. Preferably, the first stud web width is more than 20% larger than the second stud web width. In particular, the stud flanges of the first studs can form the first bearing surfaces and the stud flanges of the second studs the second bearing surfaces.

In an advantageous way, the first and/or second studs can also be designed as double studs. Double stud construction means walls in which two adjacent rows of studs are planked at least on their external stud flanges, with the paneling forming room wall surfaces. The stud web width then refers to the width of the double stud. Particularly advantageous is the embodiment, in which only the first studs are double studs.

According to the invention, it is preferred that the first and/or second studs are selected from a group consisting of U-studs, C-studs, M-studs, Z-studs or omega-studs. C-studs are particularly preferred for the first and second studs.

An advantageous embodiment of the invention provides that the first and second stud webs are arranged parallel to each other. In particular, the first stud webs may be perpendicular to the first paneling and the second stud webs perpendicular to the second paneling. This contributes in particular o a good sound insulation.

An advantageous embodiment of the invention provides that the third stud elements comprise third studs each having a third stud web and two third stud flanges arranged on the third stud web, wherein the third stud web has a third stud web width. The third stud web width can be equal to the second stud web width or smaller than the second stud web width. Preferably, the third stud web width is at least 20% smaller than the second stud web width.

According to the invention, it is preferred that the third studs are selected from a group consisting of U-studs, C-studs, M-studs, Z-studs or omega-studs. C-studs are particularly preferred.

The sound insulation can be further improved if the third stud webs are arranged parallel to the paneling. In particular, the third stud webs may be arranged perpendicularly to the second stud webs. This arrangement allows a shallow installation depth to be achieved, because the web width of metal studs is usually larger than the flange width. The low construction depth is advantageous because in this way, the facing shell requires less space. This means that the facing shell either protrudes less into the room or the recess must be less deep in order to integrate the facing shell flush into the wall.

A preferred embodiment provides that the third stud elements are attached to the second paneling via a decoupling element. The decoupling element can decouple the third stud elements from the second paneling in terms of vibration. In particular, the decoupling element can be a direct swinging hanger. This contributes in particular to a good sound insulation.

Another preferred embodiment provides that the third stud elements are arranged freestanding, i.e. that the third studs do not contact the second paneling. This also contributes in particular to a good sound insulation.

Furthermore, it is preferred that the first and second stud elements are arranged flush with one another on a further side opposite the room side. Preferably, a third continuous paneling is provided, which covers the first and the second wall sections. The opposite side can be a second room side if the drywall is a partition wall between two rooms.

Otherwise, it can be part of an exterior wall of a building.

A preferred embodiment provides that the second wall section is connected to another building element. Preferably, the second wall section is connected to a wall running transversely to the drywall.

A preferred embodiment provides that the second wall section is arranged in a corner area. The second wall section preferably adjoins a room corner, which is formed by the common longitudinal wall and a partition wall to another room. In this area, the sound radiation which is transmitted by ranking transmission from a neighboring room is highest. By reducing the center distances of the studs here, the flanking transmission is effectively attenuated. If a facing shell is arranged in this area, this additionally attenuates the sound radiation of the second wall section, which is already greatly reduced by the smaller center distances.

A preferred embodiment provides that the first, second and third stud elements are elongated and are each arranged with a vertical longitudinal axis.

A preferred embodiment provides that the drywall is a partition wall. Preferably, the drywall is planked on both sides.

However, according to another embodiment of the invention, the drywall can also only be planked on one side, namely on the room side. In this case it can be, for example, a drywall in front of a solid construction wall or other components.

A preferred embodiment provides that the first paneling comprises panels that are arranged abutting each other. Furthermore, the second paneling can comprise panels that are arranged abutting each other. Furthermore, the third paneling can comprise panels that are arranged abutting each other. In addition, the facing shell paneling can comprise panels which are arranged abutting each other and abutting the panels of the first paneling.

According to the invention, it is preferred that the first paneling and/or the second paneling and/or the facing shell paneling comprise panels which are arranged in a single layer or in several layers.

Preferably, the first paneling and/or the second paneling and/or the third paneling and/or the facing shell paneling comprise dry construction boards, wherein gypsum boards, gypsum plaster boards, gypsum fiber boards and fibercement boards are particularly preferred. However, wood panels, chipboard panels or construction boards generally suitable for these purposes can also be used for paneling.

The first and second wall sections are preferably formed straight, the first paneling being arranged parallel to the second paneling.

According to the invention, it is preferred that an insulating material is arranged between the first stud elements and between the second stud elements respectively. According to the invention, it is also preferred that an insulating material is arranged in the recess between the third stud elements. Any insulation material for these purposes known to one skilled in the art is suitable as an insulating material. The insulating material may include, for example, glass wool, stone wool and/or biodegradable fibers, such as hemp fibers.

According to the invention, it is preferred that fastening means are provided for fastening the first paneling to the first stud elements, the second paneling to the second stud elements and the facing shell paneling to the third stud elements. In particular, the fastening means may include screws.

The object according to the invention is also achieved by a kit for the construction of a drywall with the characteristics of the drywall as described above. Accordingly, the kit comprises

- first stud elements for creating the first wall section,
- second stud elements for creating the second wall section, and
- paneling boards,
- wherein the first stud elements have a first width and the second stud elements have a second width, the second width being smaller than the first width.

Further characteristics of the kit according to the invention result from the present description of the drywall and its components.

The object according to the invention is achieved by a method for the construction of a drywall with the characteristics as described and claimed. Accordingly, it is provided that the method for the construction of a drywall comprises the following steps:

- erecting first stud elements with a first regular center distance for a first wall section,
- erecting second stud elements with a second regular center distance for a second wall section, wherein the second regular center distance is smaller than the first regular center distance,
- attaching a first paneling to the room side of the first stud elements and a second paneling to the room side of the second stud elements.

In a further development of this embodiment, it is provided that in front of the second paneling, for the formation of a facing shell, third stud elements are arranged to which a facing shell paneling is attached.

Further characteristics of the method according to the invention result from the present description of the drywall and its components.

Further goals, characteristics, advantages and application possibilities of the present invention result from the following description of embodiments based on the drawings.

All described and/or depicted characteristics, individually or in any meaningful combination, form the object of the invention, even independently of the summary in individual claims or their referrals.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION

Figure 1:
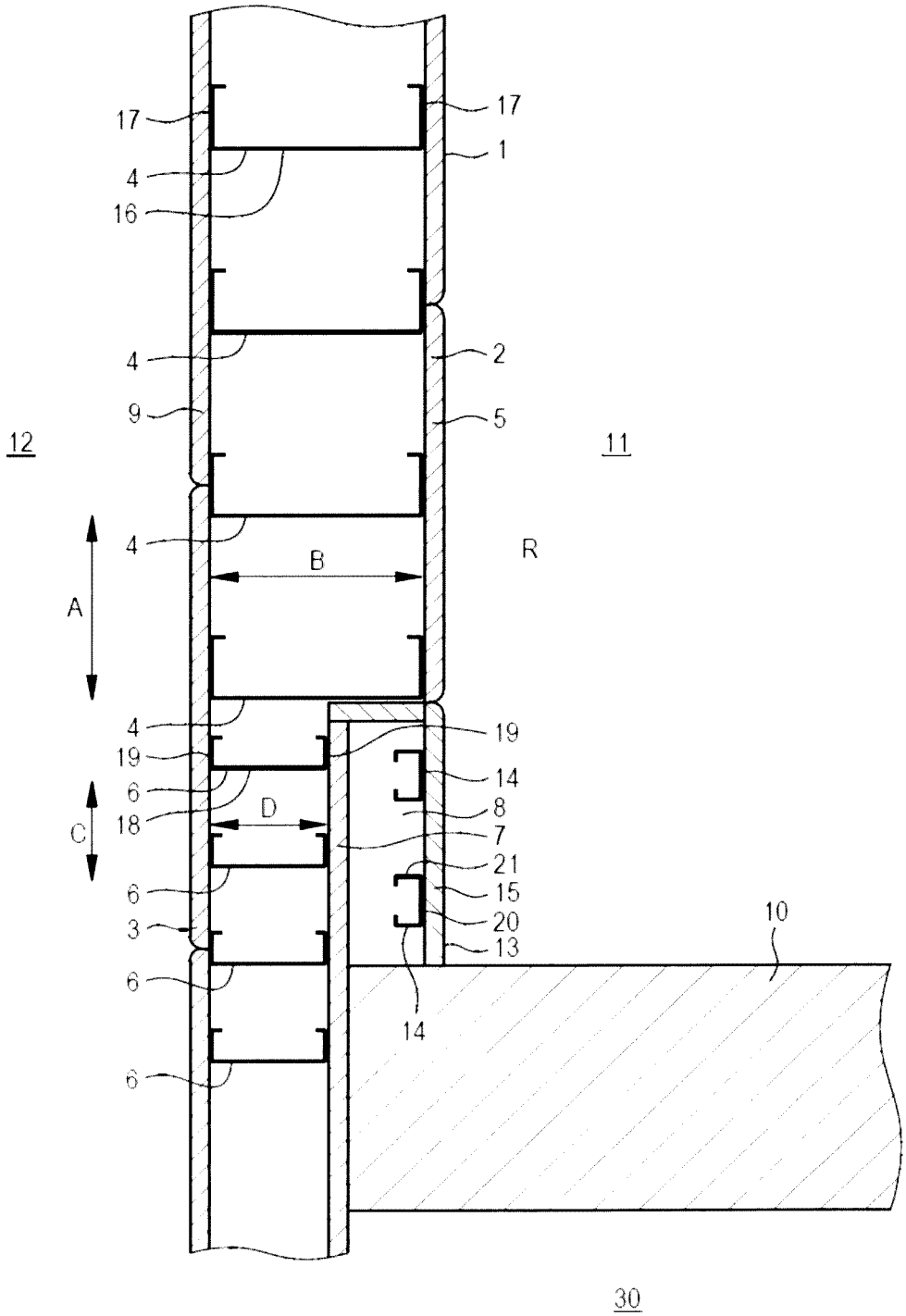
FIG. 1: a schematic representation of a drywall in a horizontal section.
Figure 2:
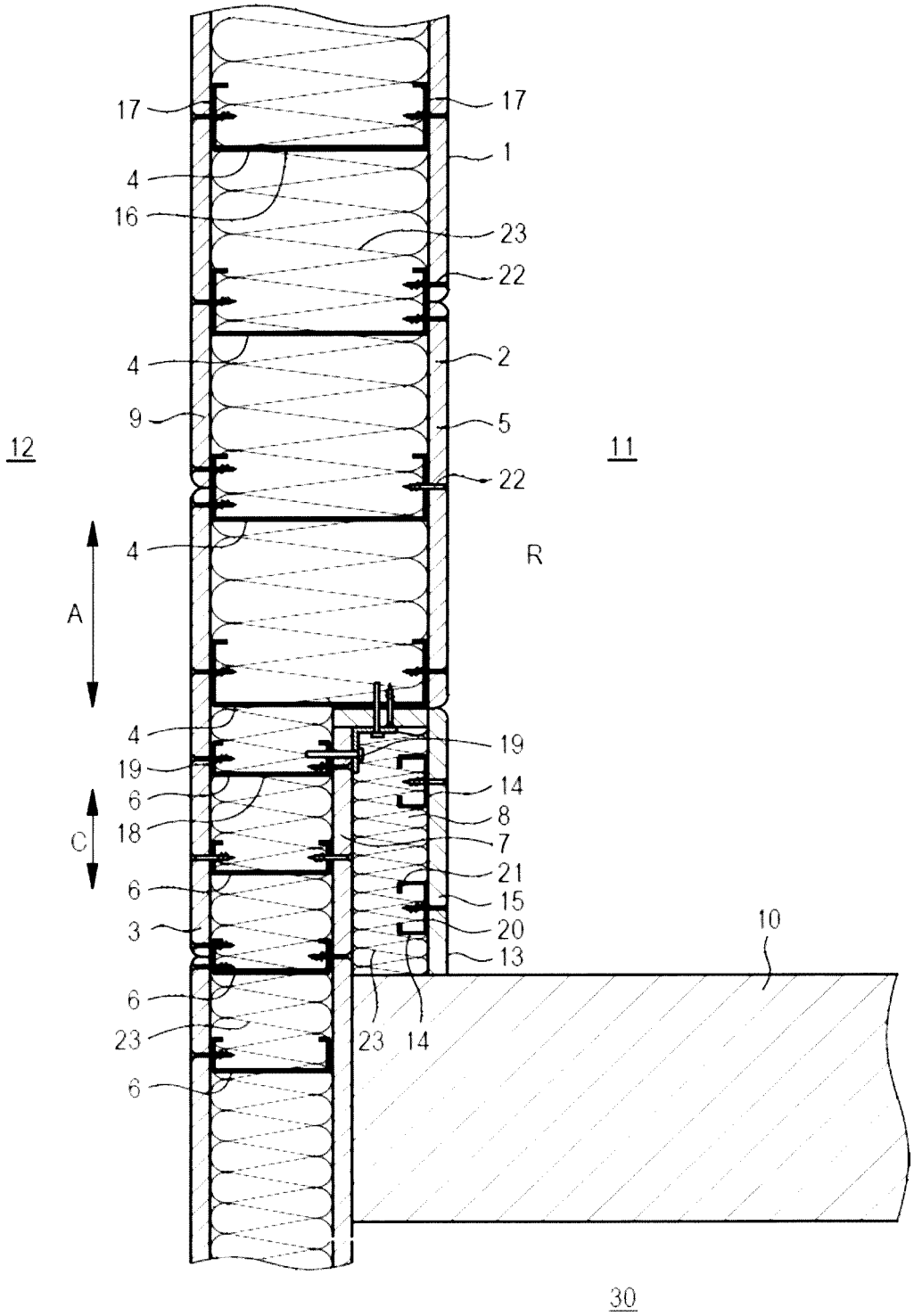
FIG. 2: a detailed representation of the drywall from FIG. 1 in a horizontal section.

FIGS. 1 and 2 show a drywall 1 with a first wall section 2 and a second wall section 3. The first all section 2 has first stud elements 4 on which a first paneling 5 is arranged on a room side R. The second wall section 3 has second stud elements 6 on which a second paneling 7 is arranged on the room side R.

In the embodiment shown, the drywall 1 is connected to a further building element 10. The further building element 10 is a wall running at right angles to the drywall 1 in the embodiment shown. The wall can be a solid wall or also a drywall.

FIGS. 1 and 2 also show that in the first wall section 2, there is a first regular center distance A between the first stud elements 4 which is greater than a second regular center distance C between the second stud elements 6 of the second wall section 3. For example, the center distance A can be 625 mm and the center distance C 312.5 mm.

The smaller center distance C in the area of the second wall section 2 has several advantages. On the one hand, the reduced center distance between the second stud elements 4 increases the rigidity of the second wall section 3 and thus reduces the flanking sound conductivity in this area. This is advantageous because the highest sound radiation from the flanking sound propagation is given in this area. On the other hand, the smaller center distance C improves the static of this area. This also makes it possible to compensate for the generally poorer static properties of narrower second stud elements 6 of the second wall section 3 (compared to the wider first stud elements 4 of the first wall section 2).

The drywall shown also has a facing shell 13, which is arranged in the area of the second wall section 3. The facing shell 13 comprises the third stud elements 14 as well as a facing shell paneling 15 attached thereto.

As shown, the second paneling 7 can be offset from the first paneling 5, so that the drywall 1 forms a recess 8 in the area of the second wall section 3 on the room side R.

The facing shell 13 is arranged in the recess 8. The facing shell 13 closes off the recess 8 on the room side so that the facing shell paneling 15 is flush with the first paneling 5. In this way, the first and second wall sections 2, 3 produce a continuous and stepless surface on the room side R. Contrary to what is shown, the facing shell 13 can also be provided without a recess being formed in the second wall section. In this case, the facing shell 13 protrudes towards the room side R relative to the first wall section 2.

FIGS. 1 and 2 also show that the second wall section 3 is arranged in a corner area. The second wall section 3 abuts the further building element 10. The flanking sound propagation is highest in corner areas because it decreases with the distance from the excitation point, i.e. the entry point of the sound waves from the sound source into the drywall 1. Therefore, additional insulation in this area, at the transition between one room and the other, is particularly effective.

The elongated first stud elements 4 have a first width B in a direction perpendicular to their longitudinal axis. The elongated second stud elements 6 have a second width D in a direction perpendicular to their longitudinal axis. The first width B is larger than the second width D. The stud elements 4, 6 are arranged flush on the side opposite to the room side R, while the recess 8 is formed on the room side R.

In the embodiment shown, the drywall 1 is designed as a partition wall which separates a first room 11 from a second room 12. However, the drywall 1, as a flanking wall, is also relevant for sound transmission between rooms 11 and 30, which are separated by the building element 10.

In the embodiment shown, the drywall 1 is planked on both sides. As shown, a paneling 9 is provided on the side of the drywall 1 facing away from the room side R. Due to the aligned arrangement of the first and second stud elements 4, 6, the paneling 9 is formed in one plane and without offset.

While for the first paneling 5, the second paneling 7 and the paneling 9 a single-layer design is shown in the figures, a two-layer or multi-layer design of the paneling can be provided instead. Single-layer and multi-layer paneling can also be combined in the different wall sections. The paneling is typically composed of panels arranged next to and/or on top of each other. The panels can be formed in particular as gypsum plaster boards, gypsum fiber boards or fiber cement boards. Wall boards made of other materials are also possible.

In the example shown, the first stud elements 4 are formed as first studs, each comprising a first stud web 16 and two first stud flanges 17 arranged on the first stud web 16. The first stud webs 16 have the width B. The second stud elements 6 are formed as second studs, each with a second stud web 18 and two second stud flanges 19 arranged on the stud web 18. The second stud webs 18 have the width D. The first stud flanges 17 are perpendicular to the first stud web 16 and the second stud flanges 19 are perpendicular to the second stud web 18. The third stud elements 14 are formed as third studs which each have a third stud web 20 and two third stud flanges 21 which are arranged on the third stud web 20. The third stud flanges 21 are perpendicular to the third stud web 20. In the exemplary embodiment shown, the first, second and third studs are each formed as C-studs.

The first, second and third studs are each formed as metal studs. The first, second and third studs can be formed as simple dry construction studs and have a material thickness between 0.4 mm and 1 mm. The first, second and/or third studs can, however, also be designed as light-gauge studs and have a material thickness of the metal sheet between 1 mm and 5 mm.

The first and second stud elements 4, 6 are arranged in such a way that the first and second stud webs 16, 18 are arranged parallel to each other. The first and second stud flanges 17, 19 can point in the same direction, starting from the first and second stud web 16, 18 with their stud flanges 17, 19, respectively. The first paneling 5 is arranged on the first stud flanges 17, the second paneling 7 on the second stud flanges 19.

The third stud elements 14 are arranged in front of the second paneling 7 in the recess 8. In this case, the third stud webs 20 are arranged perpendicular to the first and second stud webs 16, 18. The facing shell paneling 15 is arranged on the third stud webs 20. The third stud flanges 21 extend from the third stud webs 20 toward the second paneling 7. In the embodiment shown, the third stud elements 14 are arranged freestanding and do not abut the second paneling 7.

In addition, FIG. 2 shows that the first paneling 5 is connected to the first stud flanges 17 with fastening means 22. The second paneling 7 is connected to the second stud flanges 19 by further fastening means 22. The facing shell paneling 15 is connected to the third stud flanges 20 by further fastening means 22. In the embodiment shown, fastening means 22 are formed as screws which extend through the respective paneling into the first stud flange 17, the second stud flange 19 or the third stud web 20. Other types of fastening, in particular with staples, nails and/or adhesives, are also possible.

FIG. 2 also schematically shows that the drywall can be provided with insulating material 23. The insulating material 23 is arranged in the first wall section 2 between the first stud elements 4 and in the second wall section 3 between the second stud elements 6. Insulation material 23 can also be provided in the• recess 8 in the space formed between the facing shell paneling 15 and the second paneling 7.

Figure 3:
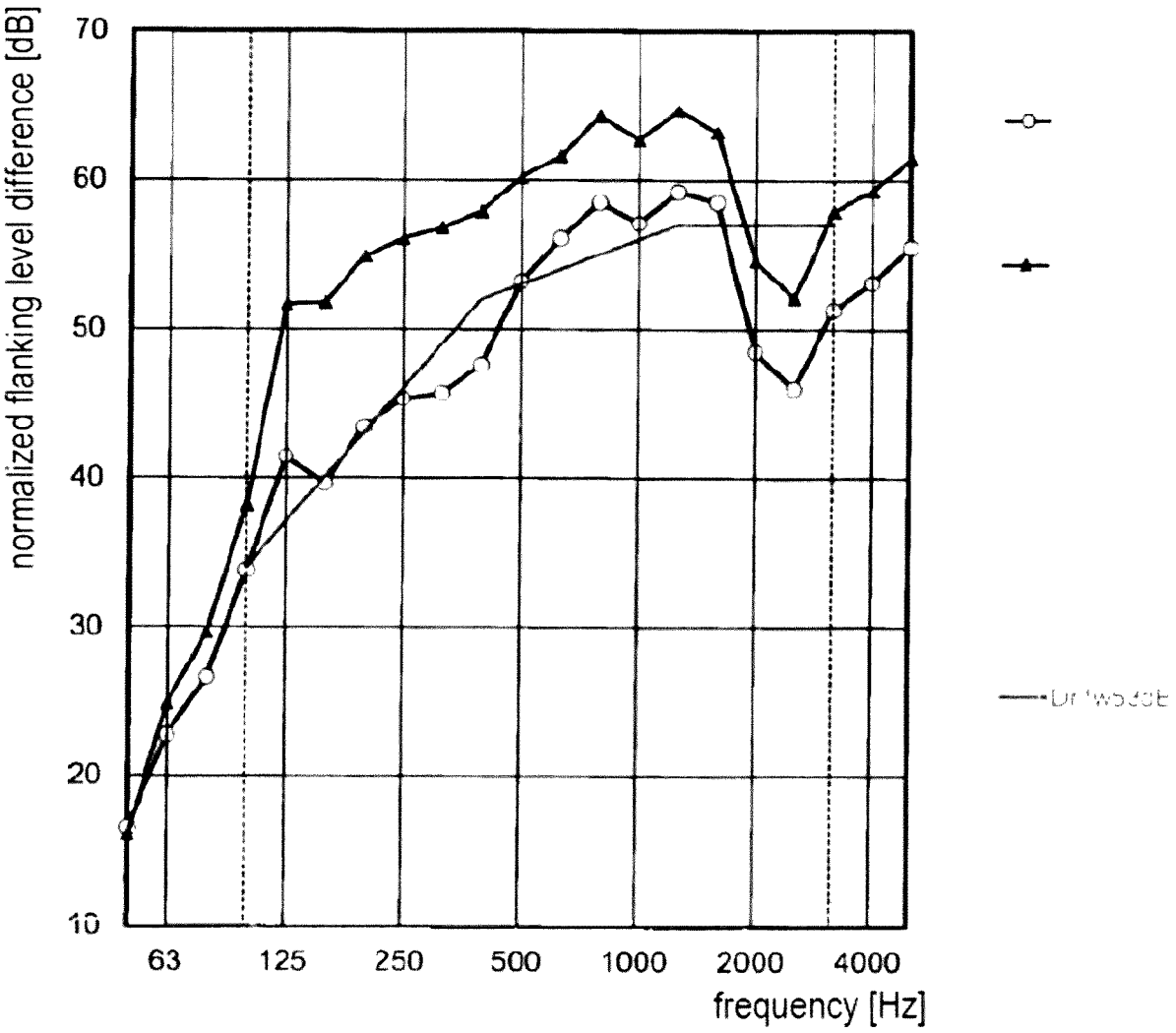
FIG. 3: measurement of a normalized flanking level difference of a drywall with partial shielding by means of a facing shell and a drywall without partial shielding by means of a facing shell.

FIG. 3 shows measurements of the normalized flanking level difference Dn,f in decibels performed in acoustic testing facilities according to DIN EN ISO 10848-3 (as valid on 1 Nov. 2019). Shown here is the measurement on a room-high angular arrangement in which a partition wall and a flanking wall form a corner area.

In the measured example, the flanking wall was created with a CW-stud with the following dimensions: stud web width: 147 mm; stud flange width: 50 mm; material thickness: 1.5 mm. The center distance was 625 mm. The flanking wall is planked with 15 mm thick Knauf Diamant X gypsum plasterboards. The flanking wall is provided with 150 mm thick mineral wool insulation.

The partition wall 10 arranged perpendicular to the flanking wall was created in the measured example with a CW-stud with the following dimensions: stud web width: 97 mm; stud flange width: 50 mm; material thickness: 1.5 mm. The center distance was 62.5 mm. The partition wall is planked with 15 mm thick Knauf Diamant X gypsum plasterboards. The partition wall is provided with 80 mm thick insulation material.

The T-joint between the flanking wall and the partition wall is designed as an angular screw joint.

The measuring line marked with circles refers to the aforementioned wall without facing shell, while the measuring line marked with triangles refers to the wall with facing shell. The horizontal width of the facing shell is 1.2 m. The depth of the facing shell is 0.12 m. The facing shell is arranged room-high in the corner area in front of the flanking wall.

The shown measurement results show that the solution with facing shell results in a considerable improvement of sound insulation. The measurement results show that a considerable improvement is achieved over almost the entire frequency range. FIG. 3 additionally also shows the weighted normalized flanking level difference Dn,f,w for the solution without facing shell. It is determined according to DIN EN ISO 10848-3 and amounts to 53 dB.

Figure 4:
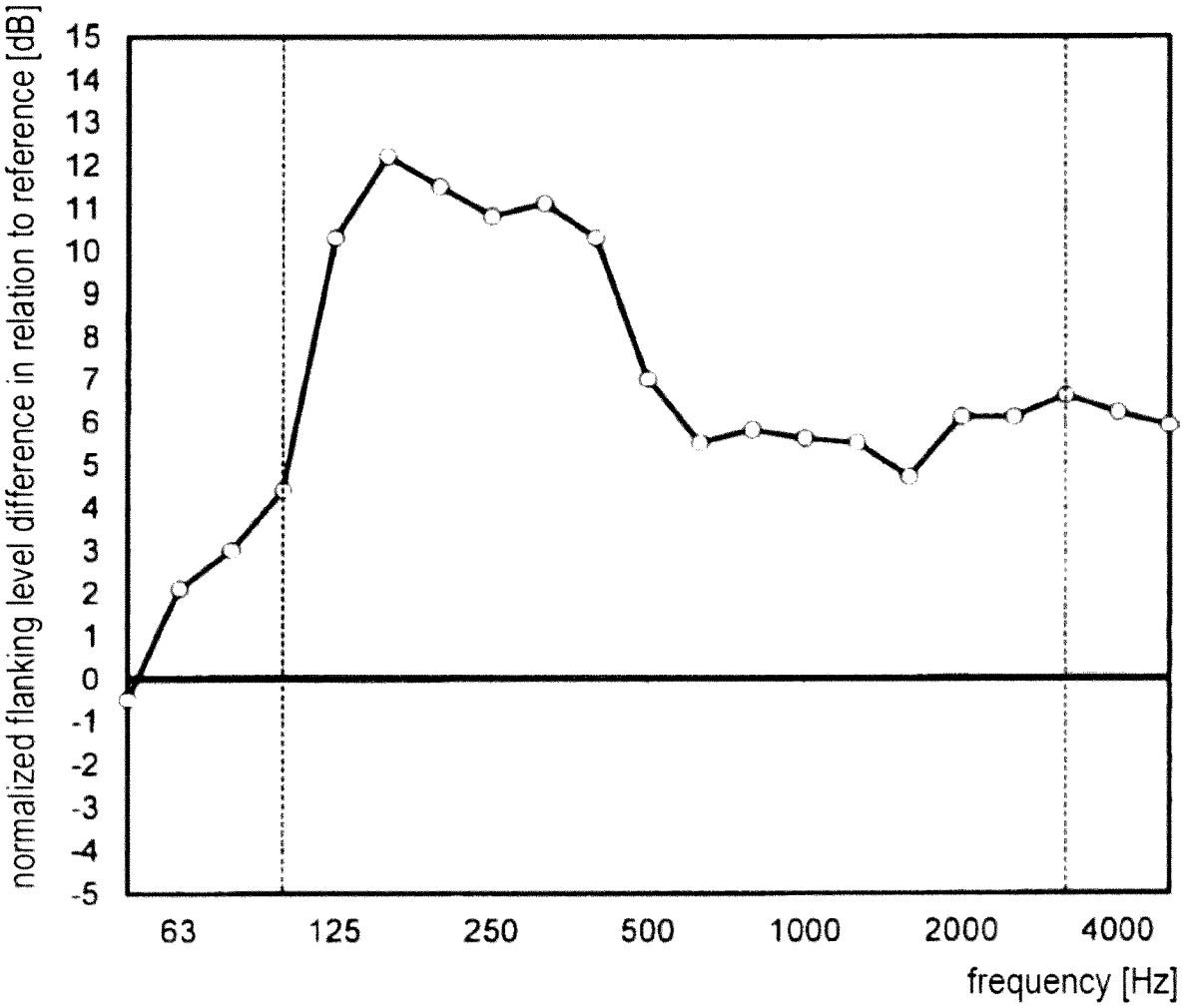
FIG. 4: normalized flanking level difference of the drywall with partial shielding from FIG. 3 relative to the normalized flanking level difference of the drywall from FIG. 3 without partial shielding by means of a facing shell.

Finally, for the measurement results shown in FIG. 3, FIG. 4 shows the normalized flanking level difference Dn,f in decibels for the wall with facing shell in relation to the design without facing shell. Here, it can be clearly seen that in the range from about 100 to 4,000 Hz, the normalized flanking level difference Dn,f is more than 5 dB higher. In the range up to about 500 Hz, the difference is even more pronounced and lies at the peak at more than 10 dB.

Embodiments have been discussed in the foregoing description. However, the embodiments discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

What is claimed is:

1. A drywall comprising a first wall section with first stud elements, wherein the first stud elements are arranged with a first regular center distance, wherein a first paneling is arranged in the first wall section at least on a room side of the first stud elements, wherein the drywall further comprises a second wall section with second stud elements, wherein a second paneling is arranged in the second wall section at least on the room side of the second stud elements and wherein the second stud elements are arranged with a second regular center distance which is smaller than the first regular center distance, wherein in the second wall section, in front of the second paneling, a facing shell is arranged comprising third stud elements with a facing shell paneling arranged thereon, wherein the drywall in the area of the second wall section forms a recess on the room side, wherein the facing shell is arranged in the recess.

2. The drywall according to claim 1, wherein the facing shell fills the recess in such a way that the facing shell paneling is flush with the first paneling.

3. The drywall according to claim 1, wherein the first stud elements have a first width in a direction perpendicular to their longitudinal axis, and that the second stud elements have a second width in a direction perpendicular to their longitudinal axis, wherein the first width is greater than the second width.

4. The drywall according to claim 1, wherein the first stud elements comprise first studs having a first stud web and two first stud flanges disposed on the first stud web, wherein the first stud web has a first stud web width, and that the second stud elements comprise second studs having a second stud web and two second stud flanges disposed on the second stud web, wherein the second stud web has a second stud web width, and wherein the first stud web width is greater than the second stud web width.

5. The drywall according to claim 4, wherein the third stud elements comprise third studs having a third stud web and two third stud flanges arranged on the third stud web, wherein the third stud web has a third stud web width which is less than the second stud web width.

6. The drywall according to claim 4, wherein each first stud and/or each second stud is made of sheet metal and that a material thickness of the sheet metal is between 0.4 mm and 5 mm.

7. The drywall according to claim 1, wherein the third stud elements are fastened to the second paneling or that the third stud elements are arranged free-standing.

8. The drywall according to claim 1, wherein the first and second stud elements are arranged flush with one another on a further side opposite the room side.

9. The drywall according to claim 1, wherein the second wall section is connected to a wall running transversely to the drywall.

10. The drywall according to claim 1, wherein the drywall is a partition wall or an exterior wall.

* * * * *